US005967112A

United States Patent [19]

Haga et al.

[11] Patent Number: 5,967,112

[45] Date of Patent: Oct. 19, 1999

[54] VERTICAL INTERNAL COMBUSTION ENGINE

[75] Inventors: Nobuo Haga; Shigekazu Sakata; Masaki Tsunoda, all of Wako, Japan

[73] Assignee: Honda Giken Kogyo Kabushiki Kaisha, Tokyo, Japan

[21] Appl. No.: 09/132,892

[22] Filed: Aug. 12, 1998

[30] Foreign Application Priority Data

Sep. 12, 1997 [JP] Japan ..... 9-249208
Sep. 24, 1997 [JP] Japan ..... 9-258294

[51] Int. Cl.[6] ..... F01M 5/00; F01M 11/02

[52] U.S. Cl. ..... 123/196 W; 123/196 AB; 123/41.33

[58] Field of Search ..... 123/196 W, 196 AB, 123/41.33; 440/900; 184/104.3

[56] References Cited

U.S. PATENT DOCUMENTS

| | | | |
|---|---|---|---|
| 3,830,289 | 8/1974 | Olson | 165/51 |
| 4,357,912 | 11/1982 | Brown | 123/41.08 |
| 4,993,979 | 2/1991 | Bland et al. | 123/196 W |
| 5,215,164 | 6/1993 | Shibata | 123/196 W |
| 5,553,586 | 9/1996 | Koishikawa et al. | 123/196 W |
| 5,647,315 | 7/1997 | Saito | 123/196 AB |
| 5,687,686 | 11/1997 | Takahashi | 123/196 W |
| 5,718,197 | 2/1998 | Tsunoda et al. | 123/196 W |
| 5,758,608 | 6/1998 | Berger et al. | 123/41.33 |
| 5,775,285 | 7/1998 | Takahashi | 123/196 W |
| 5,778,847 | 7/1998 | Takahashi et al. | 123/41.33 |
| 5,778,848 | 7/1998 | Takahashi et al. | 123/196 AB |
| 5,803,036 | 9/1998 | Takahashi et al. | 123/196 W |

FOREIGN PATENT DOCUMENTS 63-164508 10/1988 Japan .

*Primary Examiner*—Noah P. Kamen
*Assistant Examiner*—Jason Benton
*Attorney, Agent, or Firm*—Armstrong, Westerman, Hattori, McLeland & Naughton

[57] ABSTRACT

A vertical internal combustion engine in which lubricating oil can be cooled efficiently is provided. The engine includes a crankshaft directed in a vertical direction, a lubricating oil pump, an oil filter and a cooling water pump. A lubricating oil passage is arranged along a side wall of a main body of the engine and extends between the lubricating oil pump and the oil filter, a cooling water chamber is formed around the lubricating oil passage, and a branch water passage communicating with the cooling water chamber branches at a discharge side of the cooling water pump from a cooling water passage leading into the main body of the engine.

6 Claims, 16 Drawing Sheets

VERTICAL INTERNAL COMBUSTION ENGINE

BACKGROUND OF THE INVENTION

1. Field of the Invention

The present invention relates to a vertical internal combustion engine having a crankshaft directed substantially in a vertical direction, particularly to a lubricating oil cooling structure in such a vertical internal combustion engine for an outboard motor.

2. Description of the Related Art

In an outboard motor disclosed in Japanese Laid-Open Utility Model Publication 63-164508, an outer wall of an oil pan is cooled by cooling water discharged after passing a thermostat to cool lubricating oil. Cooling of neighborhood of cylinders of the engine is not harmed by this, because the cooling water discharged after passing the thermostat is used.

However, sometimes it is required to cool lubricating oil more effectively by other means. In such a case, a device for cooling the lubricating oil not influencing a cooling water jacket in a neighborhood of a cylinder and a cooling water jacket in a neighborhood of an exhaust passage of high temperature. Therefore, the present invention aims for providing a lubricating oil cooling structure adapted for cooling lubricating oil more positively independently of cooling of the neighborhood of the cylinder.

SUMMARY OF THE INVENTION

According to the present invention, there is provided a vertical internal combustion engine including a crankshaft directed substantially in a vertical direction, a lubricating oil pump, an oil filter and a cooling water pump, comprising a lubricating oil passage arranged along a side wall of a main body of the internal combustion engine extending between the lubricating oil pump and the oil filter; a cooling water chamber formed around the lubricating oil passage, and a branch water passage branching at a discharge side of the cooling water pump from a cooling water passage leading into the main body of the internal combustion engine and communicating with the cooling chamber.

In this vertical combustion engine, the lubricating oil discharged from the lubricating oil pump is cooled efficiently by the cooling water flowing in the cooling water chamber before the lubricating oil reaches the oil filter.

The cooling water chamber may be connected with a cooling water discharge passage through a pressure regulating valve. In this case, the volume of the branching cooling water can be restrained when discharge pressure and discharge volume of the cooling water pump are low so that the cooling water pump need be made excessively large.

The lubricating oil passage may be arranged within a side wall of the main body of the internal combustion engine, and a part outside of the side wall corresponding to the lubricating oil passage may be covered by a cover member to form the cooling water chamber.

In case that the main body of the internal combustion engine is placed on an extension case of an outboard motor through a mount case, if the branch water passage is connected with the cooling water passage leading into the main body at an interior of the mount case and the cooling water discharge passage is communicated with interior of the extension case through the mount case, the branch water passage and the cooling water discharge passage can be arranged simply and easily.

DETAILED DESCRIPTION OF THE PREFERRED EMBODIMENT

The drawings show a preferred embodiment of the present invention.

Figure 1:
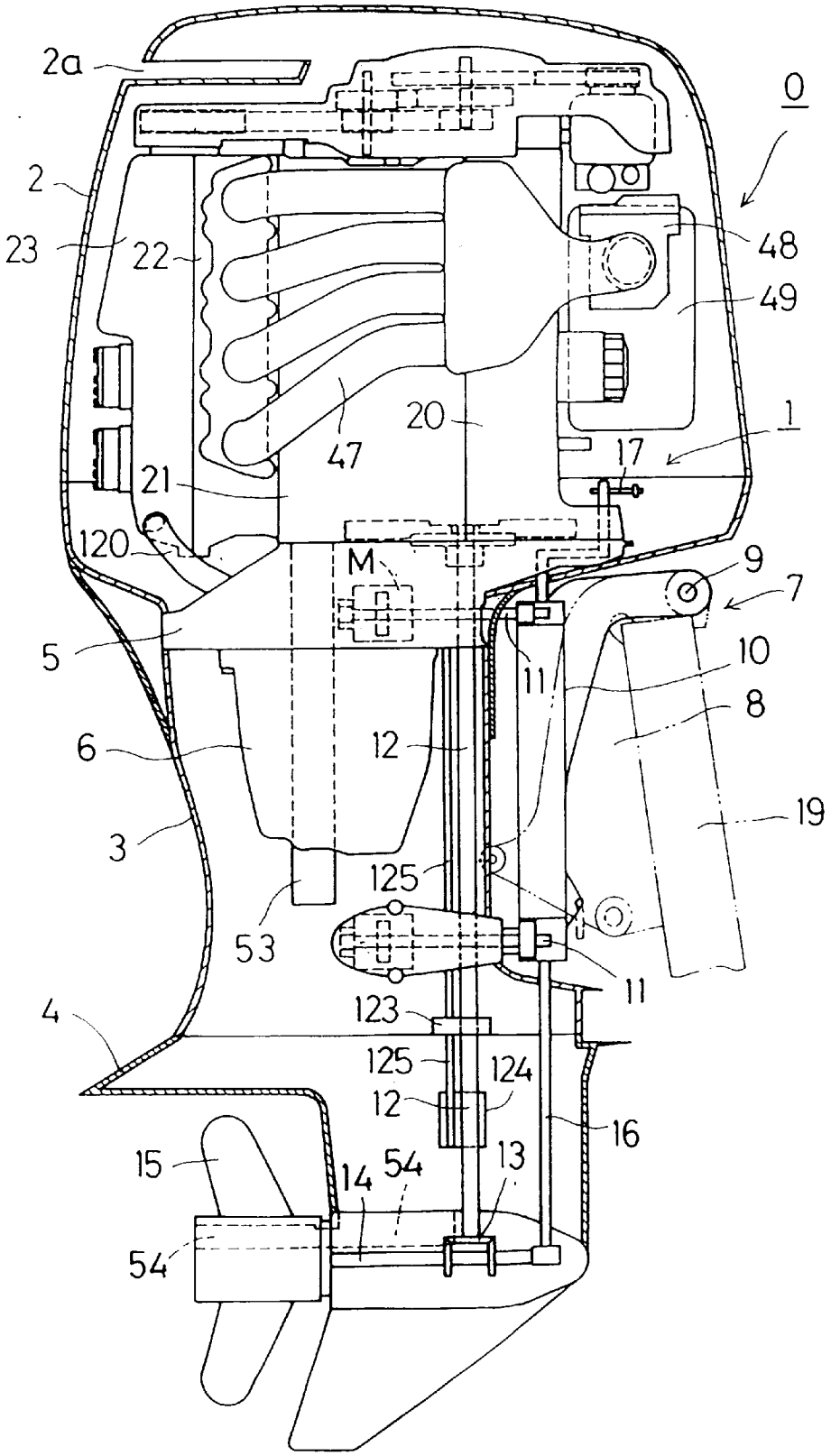
FIG. 1 is a vertical sectional side view of an outboard motor having a vertical internal combustion engine according to the present invention.

The vertical internal combustion engine 1 according to the present invention is an in-line 4-cylinder, water-cooled, 4-stroke cycle internal combustion engine which has a crankshaft 30 directed vertically and cylinders 32 directed rearward with respect to a ship body. As shown in FIG. 1, the engine 1 is mounted on an outboard motor 0 which has a main case comprising an engine cover 2 covering the vertical internal combustion engine 1, an extension case 3 and a gear case 4. Under a main body of the vertical internal combustion engine 1, a mount case 5 and a oil pan 6 are piled in order and integrally connected to the vertical internal combustion engine 1.

The outboard motor 0 is attached to a stern 19 of a motorboat (not shown) by means of an attachment device 7 which comprises a bracket 8 fixed to the stern 19, a tilt shaft 9 laterally laid on an upper end of the bracket 8, a swivel case 10 having a front end pivoted on the tilt shaft 9 so as to swing vertically, and connecting means 11 provided at upper and lower parts of a revolving portion of the swivel case 10 and having mounts M.

A steering handle (not shown) is provided at the revolving portion of the swivel case 10 and the swivel case is revolved right and left together with the outboard motor 0 when the steering handle is operated to swing right and left.

To a lower end of the crankshaft directed vertically is integrally connected a driving shaft 12 which extends within the extension case 2 downward and reaches the interior of the gear case 4. A lower end of the driving shaft 12 is connected to a propeller shaft 14 through an ahead-astern change over device 13 in the gear case 4. Therefore, power of the vertical combustion engine 1 is transmitted to the propeller 15 through the crankshaft 30, the driving shaft 12, the ahead-astern change over device 13 and the propeller shaft 14 to drive the propeller 15 rotationally.

A normal-reverse manipulating shaft 16 extends downward passing through the swivel case 10 vertically and reaches the ahead-astern change over device 13. When a manipulating lever 17 at an upper end of the normal-reverse manipulating shaft 16 is swung right and left, the ahead-reverse change over device 13 is changed over to rotate the propeller 15 in a normal or reverse direction.

Figure 7:
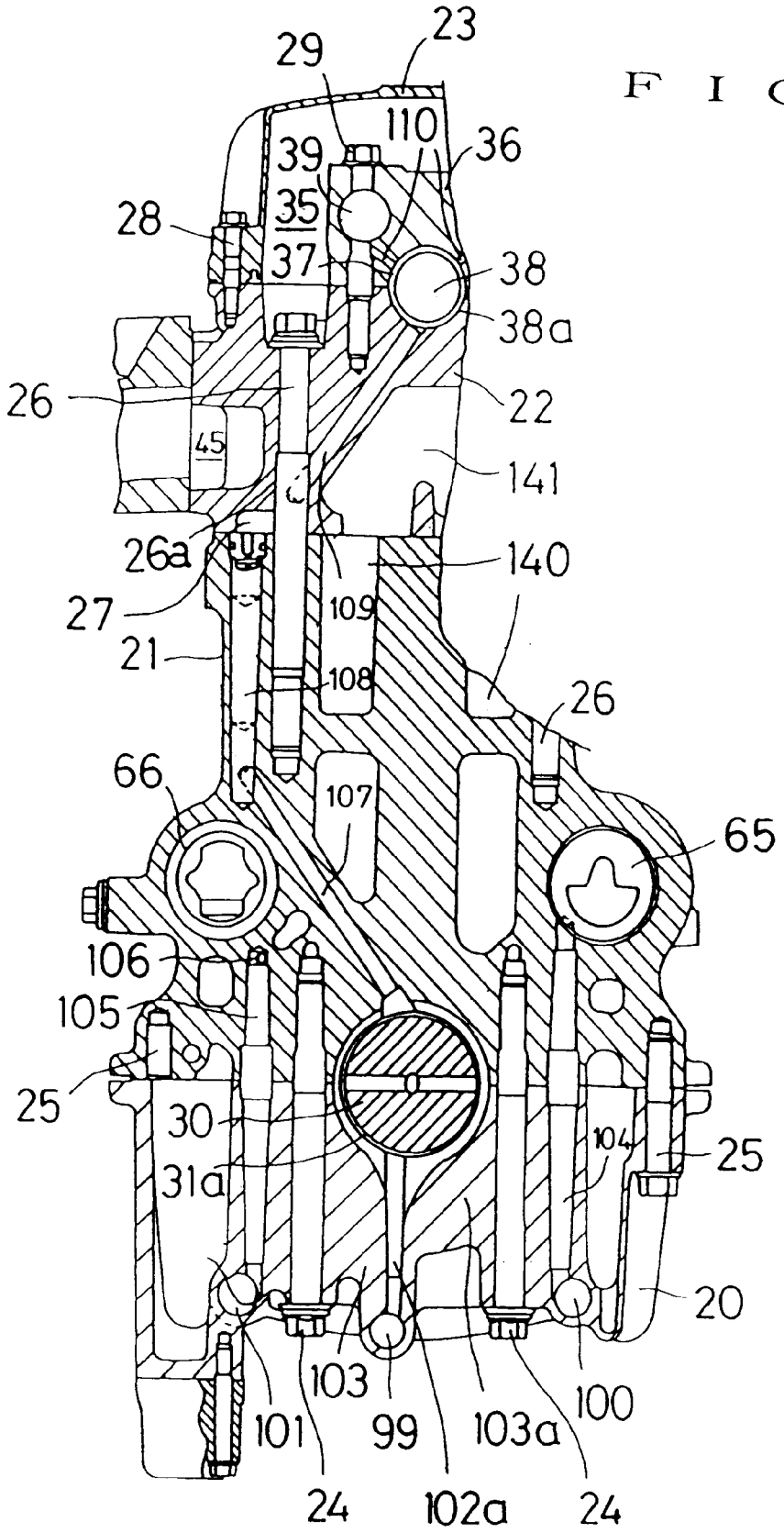
FIG. 7 is a section along the line VII—VII of FIG. 3.

The main body of the vertical internal combustion engine 1 is constituted of a crankcase 20, a cylinder block 21, a cylinder head 22 and a head cover 23. These crankcase 20, cylinder block 21, cylinder head 22 and head cover 23 are arranged from front to rear in order with respect to the ship body, and connected to each other in one body by bolts 24, 25, 26, 28 as shown in FIG. 7. As mentioned above, at under surfaces of the crankcase 20 and the cylinder block 21, the mount case 5 and the oil pan 6 are integrally connected to the crankcase 20 and the cylinder block 21 by bolts not shown.

Figure 4:
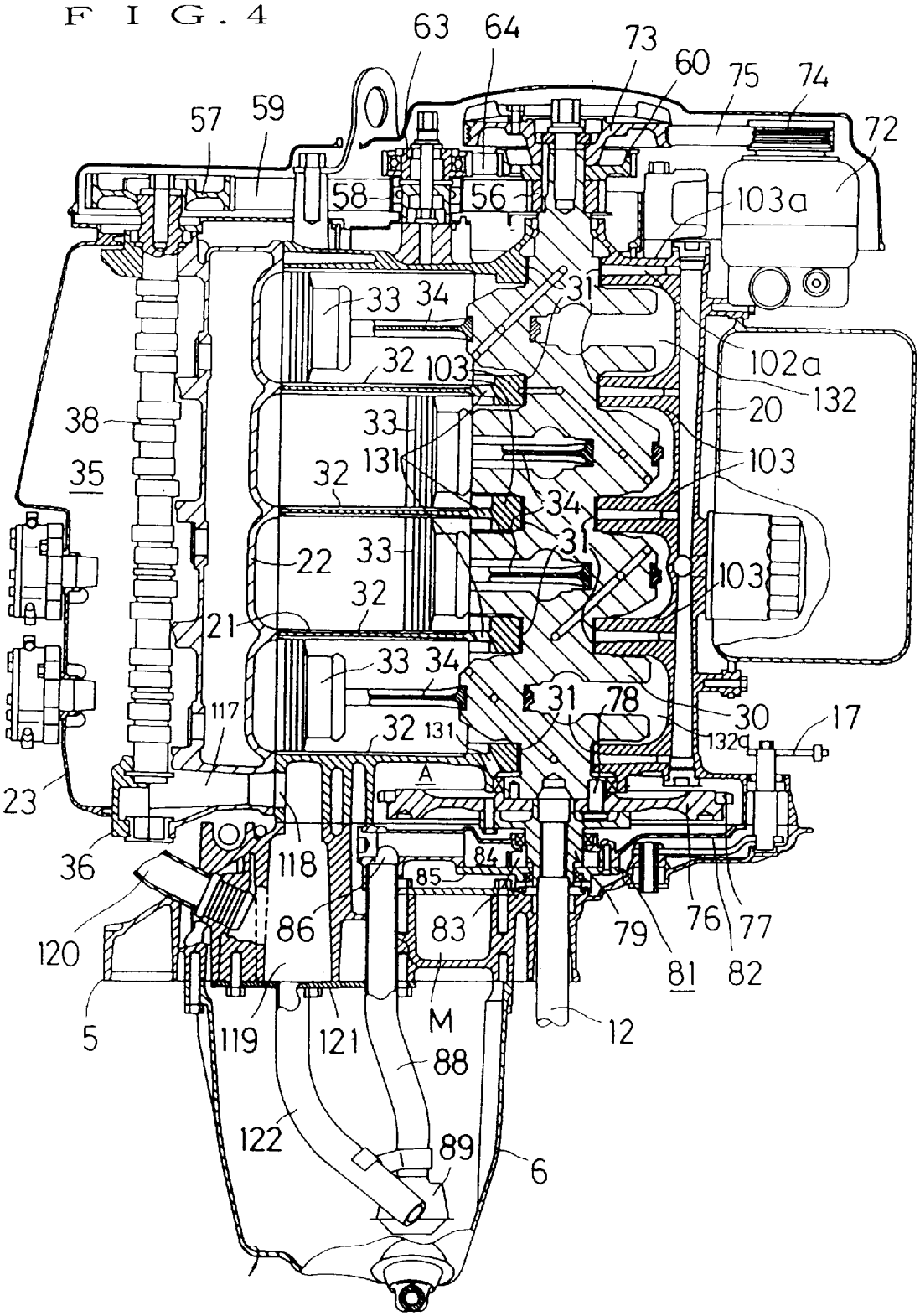
FIG. 4 is a vertical sectional side view of the internal combustion engine.

As shown in FIG. 4, the crankshaft 30 directed vertically is rotationally supported at crankshaft supporting portions 103 of the crankcase 20 and the cylinder block 21 by journal bearings 31. Cylinders 32 directed horizontally in front-rear directions are disposed at regular intervals in a vertical direction. A piston 33 is fitted to each of the cylinders 3 to slide and connected to the crankshaft 30 by means of a connecting rod 34 so that reciprocation of the piston 33 causes the crankshaft 30 to be driven to rotate clockwise as viewed from above.

Figure 8:
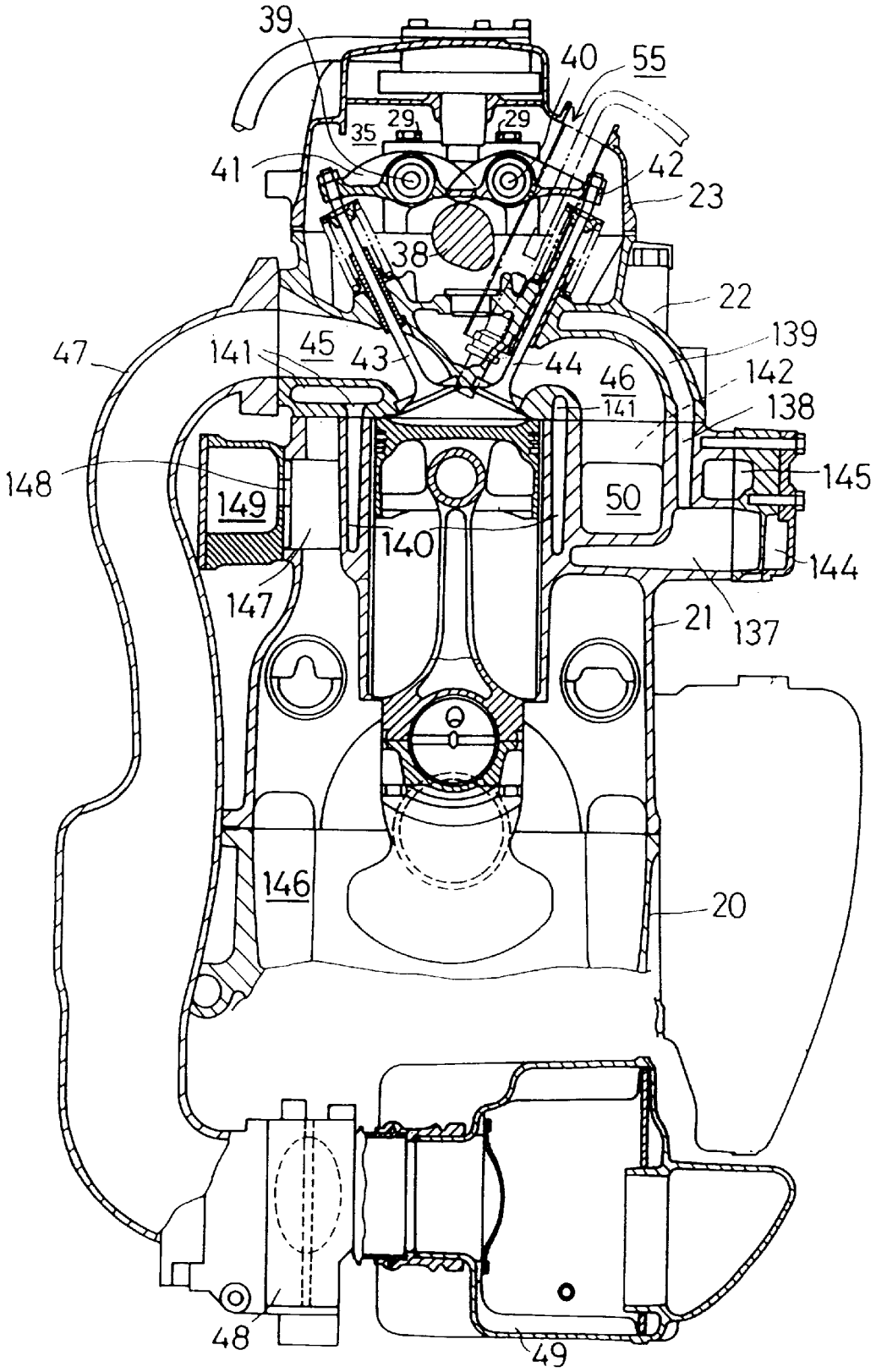
FIG. 8 is a section along the line VIII—VIII of FIG. 3.

As shown in FIGS. 7, 8, within a valve moving chamber 35, a camshaft holder 36 is attached to a top face (rear face with respect to the ship body) of the cylinder head 22 and a camshaft 38 is rotationally supported between the camshaft holder 36 and the cylinder head 22 by a journal bearing 37. At the right and left with respect to the ship body of the camshaft 38, rocker shafts 39, 40 are supported on the cam shaft holder 36 in parallel with the camshaft 38. On the rocker shafts 39, 40 are pivoted so as to swing rocker arms 41, 42 having tip ends contacted with an intake valve 43 and an exhaust valve 44 respectively. The camshaft 38 is driven to rotate at a rotational speed corresponding to a half of that of the crankshaft 30. By a valve moving device 55 which will be mentioned in the later part, the intake valve 43 and the exhaust valve 41 are driven to open and close intermittently every two revolutions of the crankshaft 30.

Figure 2:
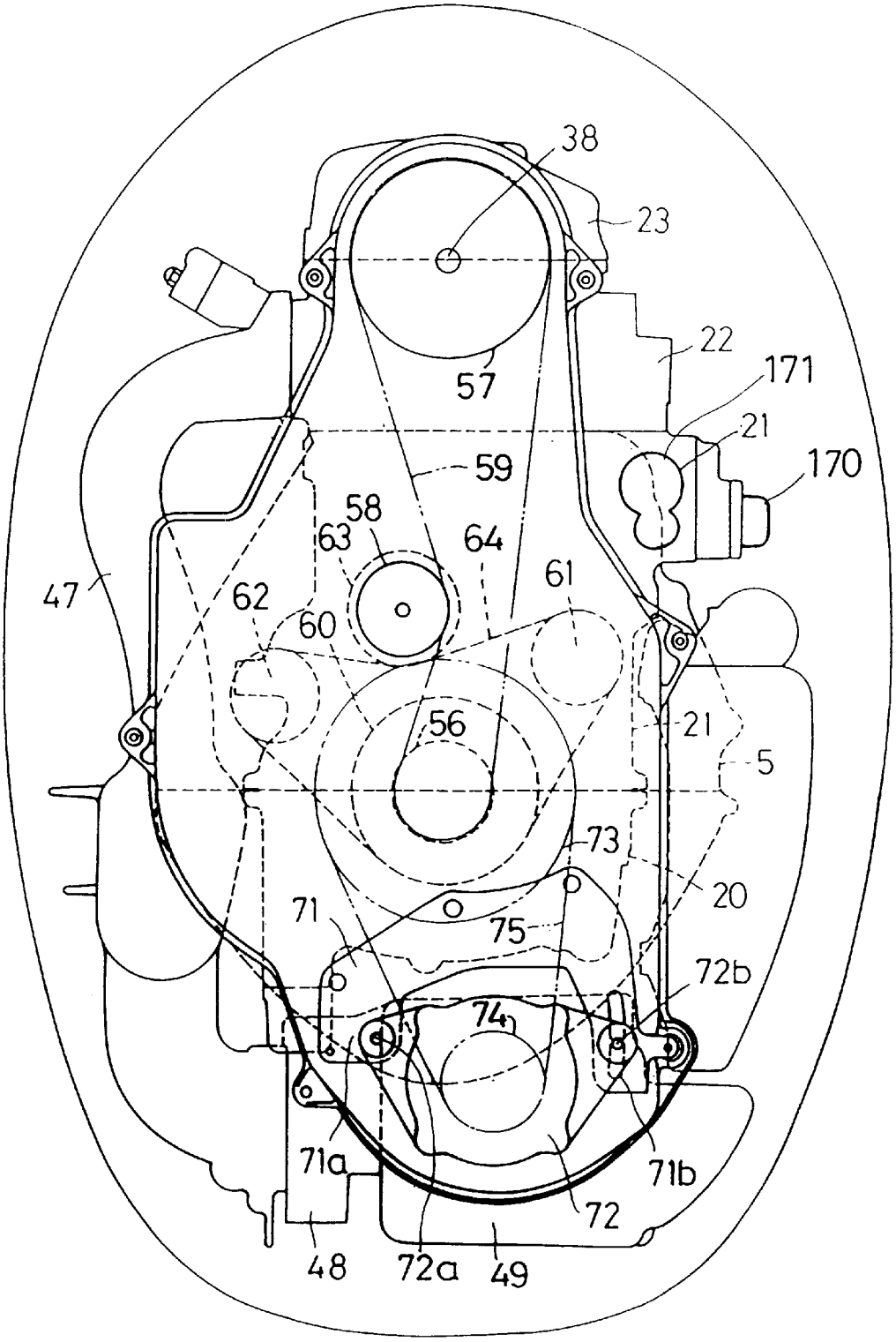
FIG. 2 is a plan view of the internal combustion engine.

As shown in FIG. 8, an intake passage 45 opened and closed by the intake valve 43 is connected with a lower stream end of an intake manifold 47 positioned on the right side with respect to the ship body (left side in FIGS. 2, 8). An upper stream end of the intake manifold 47 is connected with an intake chamber 49 through a throttle valve 48 The intake chamber 49 has an intake aperture (not shown) opening within the engine cover 2 so that air inhaled into the engine cover 2 through an intake aperture 2*a* (FIG. 1) is introduced into the intake chamber 49 and then to the intake passage 45 through the throttle valve 48 and the intake manifold 47.

Figure 11:
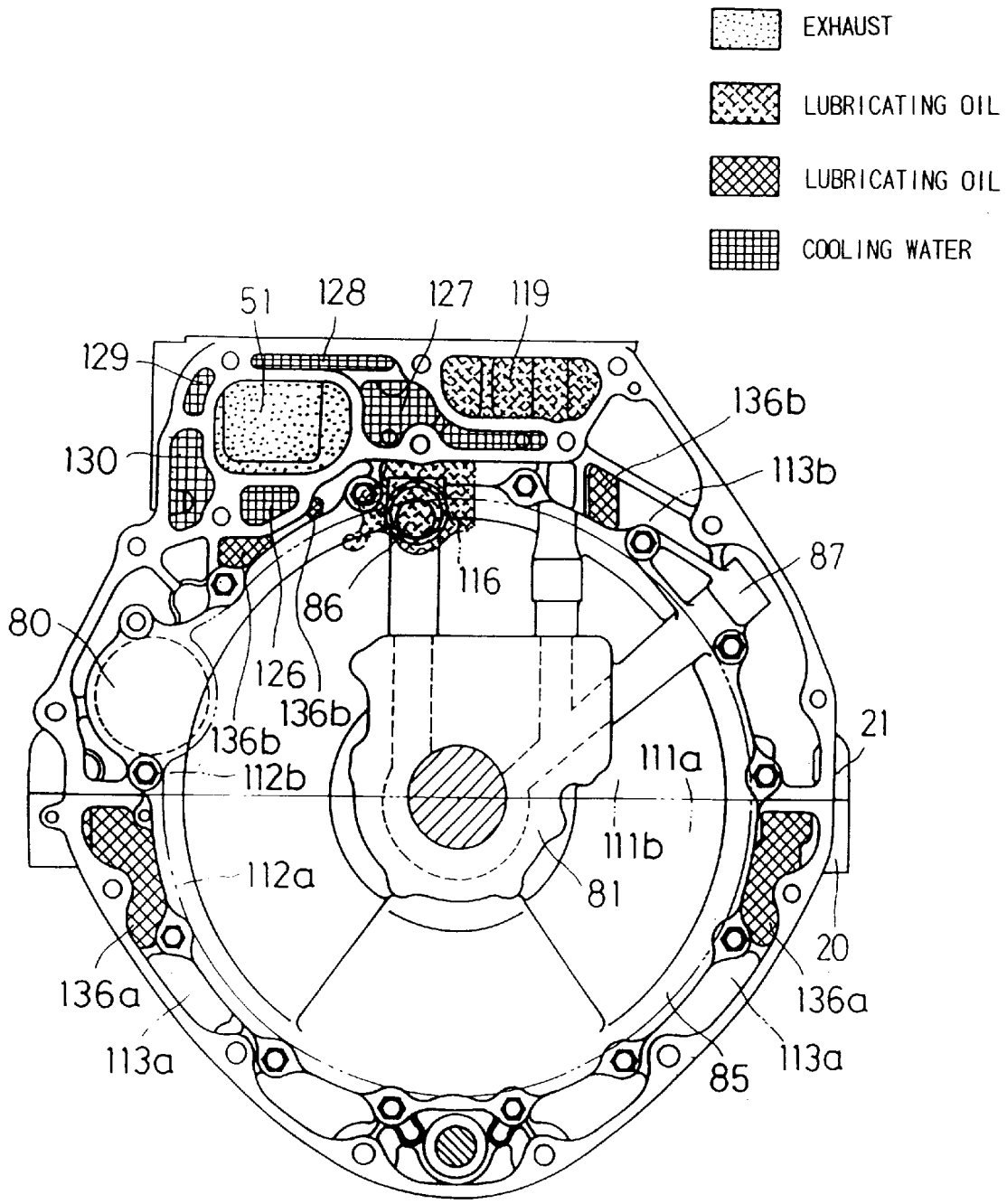
FIG. 11 is a view showing the crankcase and the cylinder block viewed from the bottom.

An exhaust passage 46 opened and closed by the exhaust valve 44 is directed to the left side with respect to the ship body (right side in FIG. 8), bent at a lower stream end toward the cylinder block 21 (toward the front with respect to the ship body) and connected to an exhaust passage 50 directed in vertical direction within the cylinder block 21. As shown in FIG. 11, the exhaust passage 50 opens to an exhaust hole 51 which communicates with an exhaust passage 52 (FIG. 17) of the mount case 5.

To a lower end of the exhaust passage 52 is connected an upper end of an exhaust pipe 53 (FIG. 1) having a lower end opening within the extension case 3. Exhaust gas discharged into the extension case 3 from the exhaust pipe 53 passes through a space within the gear case 4 to be discharged into the water through an exhaust passage 54 (FIG. 1).

The valve moving device denoted by the numeral 55 in FIG. 8 is disposed above the crankcase 20 and the cylinder block 21. Namely, as shown in FIGS. 2 and 4, a drive pulley 56 is integrally fitted to an upper part of the crankshaft 30, a driven pulley 57 is integrally fitted to an upper end of the cam shaft 38, an idler pulley 58 is pivotally supported on the cylinder block 21 and an endless belt 59 is wound a round these pulleys 56, 57 and 58.

Figure 6:
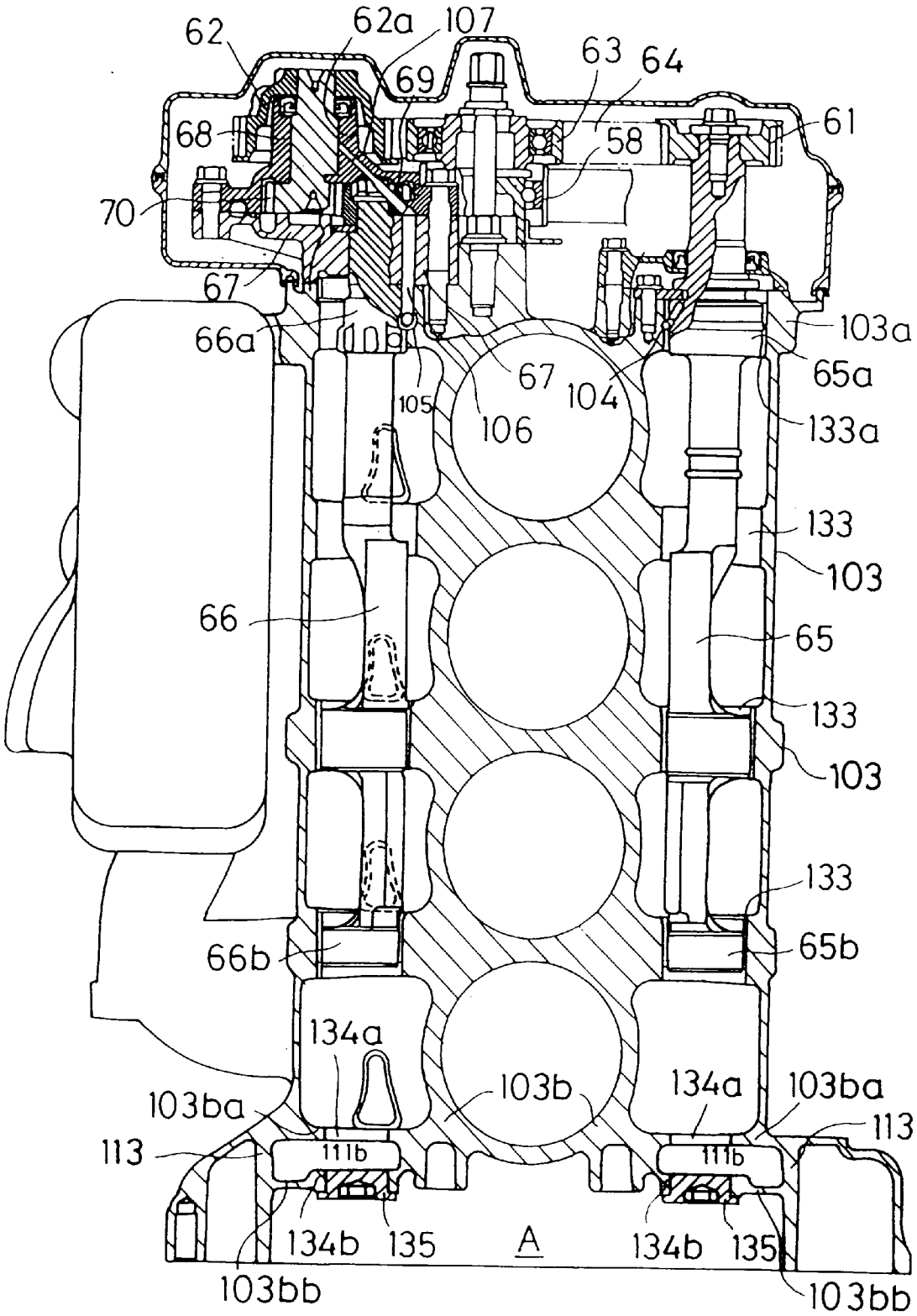
FIG. 6 is a front view showing a cross section along balancer shaft of the internal combustion engine.

Further, as shown in FIGS. 2, 4 and 6, a balancer drive pulley 60 is integrally fitted to the crankshaft 30 at a position above the drive pulley 56, balancer driven pulleys 61, 62 are provided so as to rotate freely positioned on the right and left of the cylinder 32, an idler pulley 63 concentric with the above-mentioned idler pulley 58 is pivotally supported and an endless belt 64 is wound a round these pulleys 60, 61, 62 and 63.

As shown in FIGS. 2 and 6, the balancer driven pulley 61 on the left side with respect to the ship body (right side in FIGS. 2, 6) is integrally fitted to the left side balancer shaft 65 pivotally supported in the cylinder block 21. The other balancer shaft 66 disposed symmetrically with the balancer shaft 65 about the cylinder 32 has a lower portion pivotally supported by the cylinder block 21 and an upper portion pivotally supported by a balancer supporting bracket 67 and a bracket cover 68 attached to the bracket 67, and a drive gear 69 integral with the balancer shaft 66 and a driven gear 70 integral with the balancer driven pulley 62 are engaged with each other so that the balancer shaft 65, 66 are driven to rotate with the same revolutional speed but in opposite directions.

As shown in FIGS. 2 and 4, on an upper surface of the crankcase 20 is attached a bracket 71 having an end 71*a* on which an end 72*a* of an AC generator 72 is pivoted so as to swing. Another end portion 72*b* of the generator 72 is fitted movably in an arcuate groove 71*b* formed on another end portion of the bracket 71, and fixed to the bracket 71 by fixing means not shown. An endless belt 75 is wound a round a drive pulley 73 integrally fitted to an upper end of the crankshaft 30 and a driven pulley 74 integrally fitted to an upper end of a rotary shaft of the AC generator 72.

Figure 5:
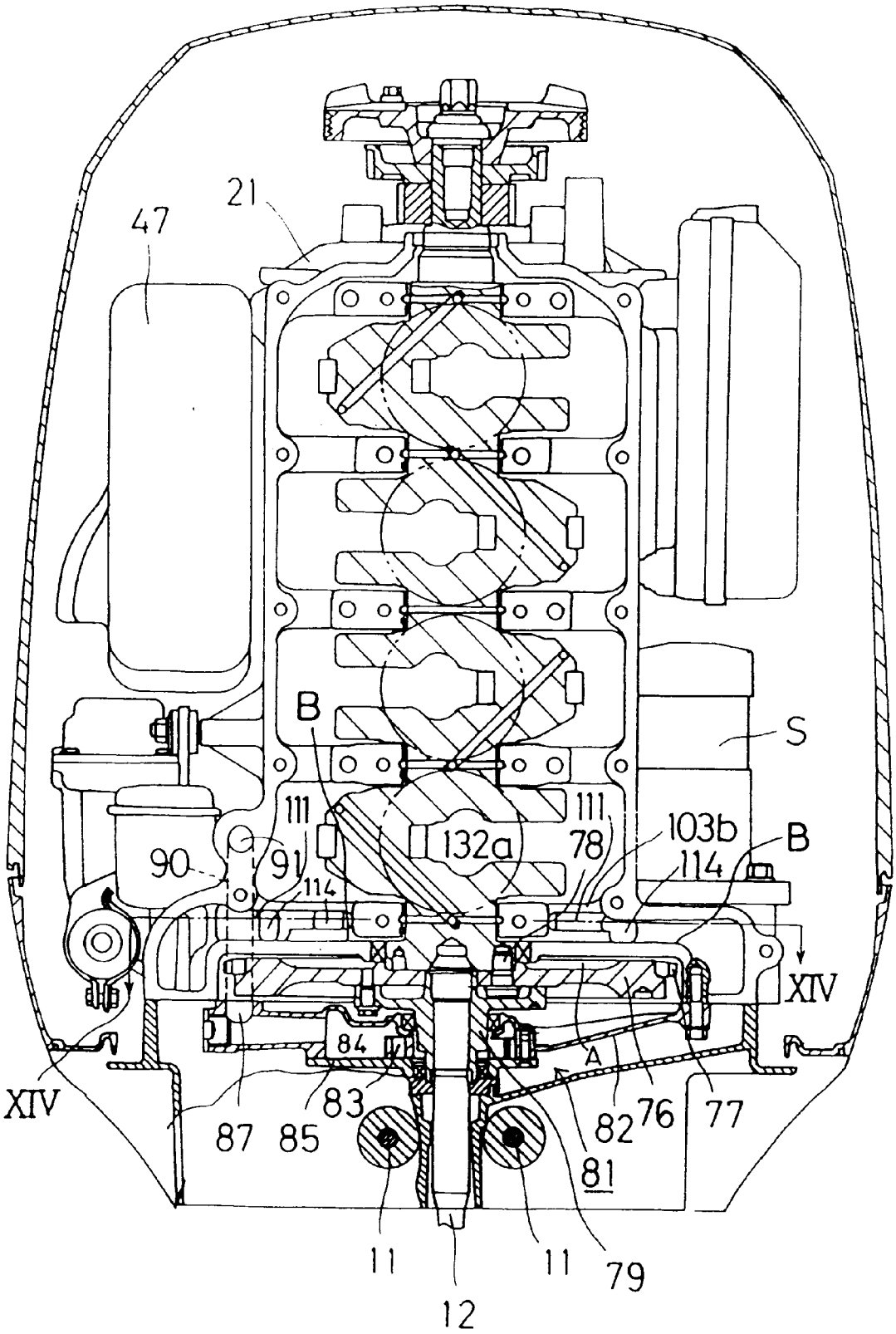
FIG. 5 is a front view of a joining surface of the cylinder block to the crankcase in the internal combustion engine.

Further, as shown in FIGS. 4 and 5, a flywheel 76 is integrally fitted by bolts 78 to a lower end of the crankshaft 30 and a ring gear 77 is formed on a circumference of the flywheel 76. On a lower surface of the flywheel is attached a connecting member 79 to which an upper end of the above-mentioned driving shaft 12 is fitted by means of splines. The ring gear 77 is engaged with a drive pinion (not shown) disposed in an arcuate recess 80 formed on a lower surface of the cylinder block 21 as shown in FIG. 11. When the drive pinion is rotated by a starter motor S shown in FIG. 5, the ring gear 77, the flywheel 76 and the crankshaft 30 are driven to rotate.

Next, the lubricating system of the vertical internal combustion engine 1 will be described.

As shown in FIG. 4, on lower surfaces of the crankcase 20 and the cylinder block 21 is provided an oil pump body 82 of a trochoid type lubricating oil pump 81 which has a rotor 83 integrally fitted to the connecting member 79, a pump chamber 84 closed by a lid 85 and a suction port 86 opening downward. A suction pipe 88 having an upper end connected with the suction port 86 extends downward within the oil pan 6 passing through a return oil hole. A strainer 89 is connected to a lower end of the suction pipe 88.

Figure 3:
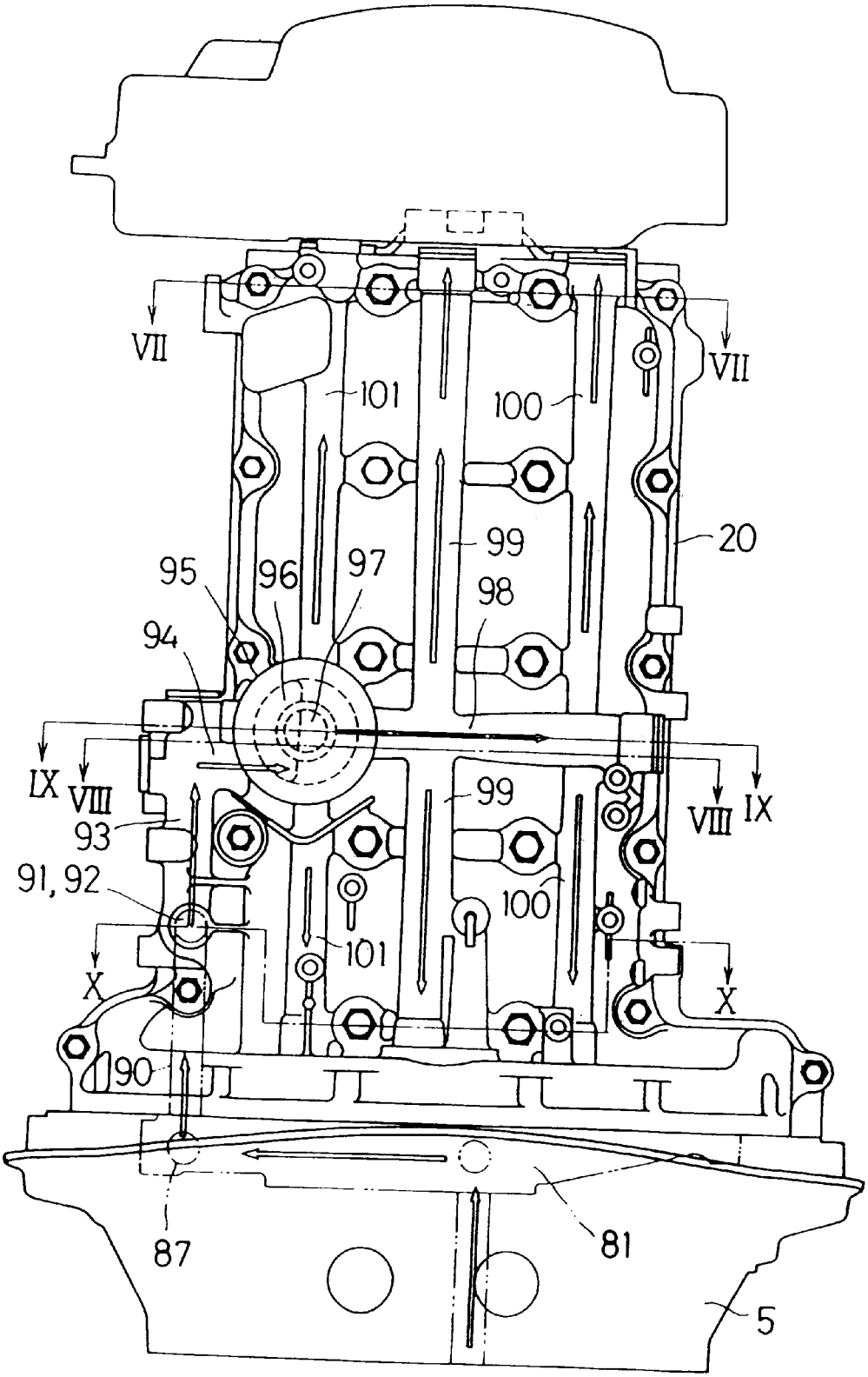
FIG. 3 is a front view of the internal combustion engine.
Figure 9:
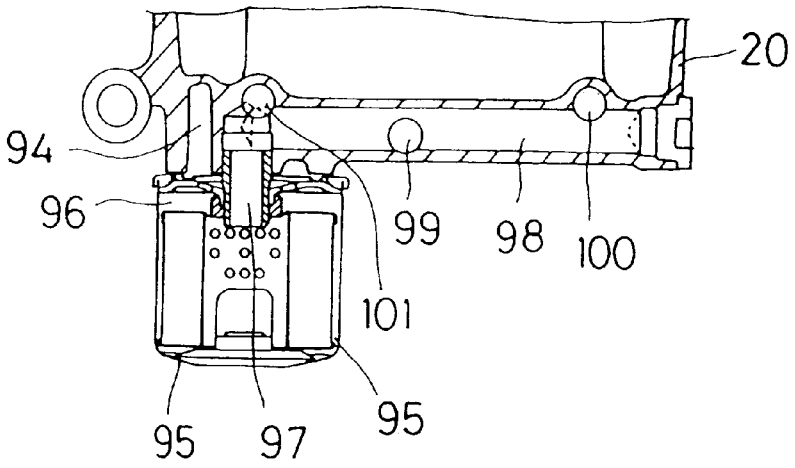
FIG. 9 is a section along the line IX—IX of FIG. 3.

As shown in FIGS. 3, 5 and 9, the lubricating oil pump 81 has a discharge port 87 connected to a lower end of a vertical oil passage 90 at the rear which is formed vertically along a right side wall of the cylinder block 21. An upper end of the vertical oil passage 90 is connected with a longitudinal horizontal oil passage 91 extending toward the crankcase 20 in front, the longitudinal horizontal oil passage 91 is connected with a longitudinal horizontal oil passage 92 within the crankcase 20, and a front end of the longitudinal oil passage 92 is connected with a horizontal oil passage 94 directed to the left (right in FIG. 3).

An oil filter 95 is provided at an upper right position on a front surface of the crankcase 20. As shown in FIGS. 3 and 9, a left end of a longitudinal horizontal oil passage 94 is connected to an intake portion 96 of the oil filter 95 and a discharge portion 97 of the oil filter 95 is connected to a communication oil passage 98 directed to the left (right in FIG. 3) of the crankcase 20.

The communication oil passage 98 communicates with a crankshaft oil passage 99 vertically positioned at a center of the width and balancer shaft oil passages. 100, 101 vertically positioned at right and left sides of the oil passage 99, respectively.

Figure 10:
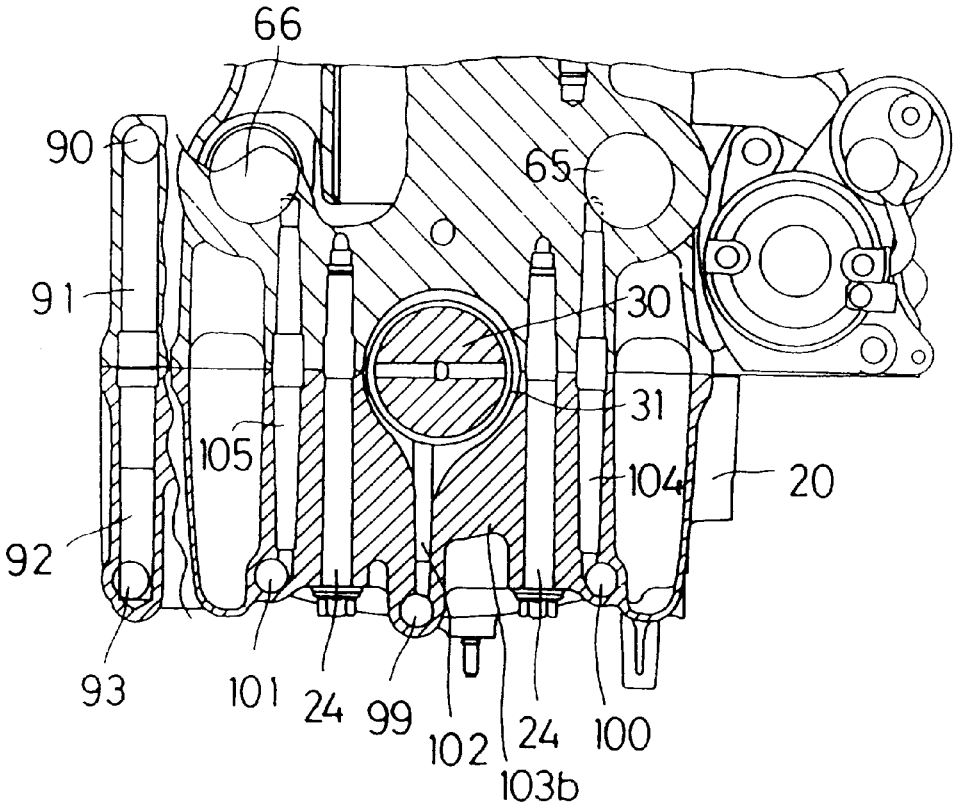
FIG. 10 is a section along the line X—X of FIG. 3.

As shown in FIGS. 7 and 10, a crankshaft oil passage 102 directed rearward horizontally is formed in each of the crankshaft supporting portions 103. A tip end of the crankshaft oil passage 102 communicates with the journal bearing 31 of the crankshaft 30, therefore the journal bearing 31 is lubricated with the lubricating oil pressurized and sent out by the lubricating oil pump 81, filtered by the oil filter 95 and brought through the above-mentioned oil passages.

In the uppermost crankshaft supporting portion 103*a* are formed balancer shaft oil passages 104, 105 directed rearward horizontally through the crankcase 20 and the cylinder block 21. The balancer shaft oil passages 104, 105 communicate with the above-mentioned balancer oil passages 100, 101 at the front ends (lower ends in FIG. 10) and with the balancer shafts 65, 66 at the rear ends (upper ends in FIG. 10).

As shown in FIG. 6, a pivot portion 65*a* at the upper end of the balancer shaft 65 is lubricated by the lubricating oil discharged from the rear end of the balancer shaft oil passage 104. The lubricating oil drops by gravity after lubricating the upper end pivot portion 65*a* and reaches a pivot portion 65*b* at the lower end of the balancer shaft 65 to lubricate the pivot portion 65*b*.

The rear end of the balancer shaft oil passage 105 is connected with the balancer shaft oil passage 106 in the cylinder block 21 and the balancer pivot bracket 67. The balancer shaft oil passage 106 is connected with the cam shaft oil passage 107 in the bracket cover 68 and the upper end of the cam shaft oil passage 107 is opened to the pivot portion 62*a* of the balancer driven pulley 62 to lubricate the pivot portion 62*a* too.

As shown in FIG. 7, in an upper part of the cylinder block 21 is formed a camshaft oil passage 107 directed obliquely rearward horizontally. The camshaft oil passage has a front end connected with the Journal bearing 31*a* at the uppermost crankshaft supporting portion 103*a* and a rear end connected with a front end of a camshaft oil passage 108 directed rearward horizontally. A rear end of the camshaft oil passage 108 is connected with a camshaft oil passage 109 in the cylinder head 22 through a communication passage 27 of the cylinder head 22 and a hole 26*a* of the bolt 26 for connecting the cylinder head 22 to the cylinder block 21. A rear end of the camshaft oil passage 109 opens to the pivot portion 38*a* of the camshaft 38. A rocker oil passage 110 opening to the pivot portion 38*a* is formed in the camshaft holder 36.

Thus, a part of the lubricating oil supplied to the uppermost journal bearing 31*a* is sent to the pivot portion 38*a* of the camshaft 38 through the cam shaft oil passages 107, 108 and 109 to lubricate the pivot portion 38*a*. A part of the lubricating oil supplied to the pivot portion 38*a* is sent to center holes (not shown) of the rocker shafts 39, 40 through the rocker oil passage 110 and further to pivot portions (not shown) of the rocker arms 41, 42 to lubricate the pivot portions.

As shown in FIGS. 5, 6 and 11, at vertically middle positions of the lowermost crankshaft supporting portions 103*b* in the crankcase 20 and the cylinder block 21, horizontal flat oil passage spaces 111*a*, 111*b* are formed. Peripheries of the flat oil passage spaces 111*a*, 111*b* of the crankcase 20 and the cylinder block 21 are bounded by partition walls 112*a*, 112*b* respectively, and the flat oil passage spaces 111*a*, 111*b* communicate with partitioned spaces 113*a*, 113*b* formed on the outside of the partition walls 112*a*, 112*b* through return oil passages (not shown). Under the partitioned spaces 113*a*, 113*b* are formed vertical communication holes 136*a*, 136*b* which communicate with a partitioned space formed in the mount case 5. Under the partitioned space is formed a return oil hole 116 communicating with a space within the oil pan.

As shown in FIGS. 1 and 4, the valve moving chamber 35 surrounded by the cylinder head 22 and the head cover 23 communicates with an oil passage space 119 of the mount case 5 through a return oil hole 117 of the cylinder head 22 and a return oil passage 118 of the cylinder block 21, as well as through a communication pipe 120. The lower end of the oil passage space 119 is closed by a lid 121 which is penetrated by a return oil pipe 122 communicating with the oil passage space 119. The return oil pipe 122 has an upper end connected to the lid 121 and a lower end opening to a bottom portion of the oil pan 6.

As shown in FIG. 6, pivot holes 133 for inserting the balancer shafts 65, 66 are worked in the crankshaft supporting portions 103 by inserting a tool (not shown) from the uppermost crankshaft supporting portion 103*a* downward. In upper and lower partition walls 103*ba*, 103*bb* of the lowermost crankshaft supporting portion 103*b* are formed work holes 134*a*, 134*b* smaller than the pivot holes 133. The work hole 134*b* in the lower partition wall 103*bb* is closed by a plug 135 to tightly separate the oil passage space 111*b* from the lower space A for the flywheel.

The cooling system of the vertical internal combustion engine 1 will be described. As shown in FIG. 1, a cooling water pump 123 driven by the driving shaft is provided at a joint part between the extension case 3 and the gear case 4. In a side wall of the gear case 4 is formed a suction port 124 with a net (not shown) stretched. Water entering into the gear case 4 through the suction port 124 is sucked by the cooling water pump 123 and sent to the vertical internal combustion engine 1 through a suction pipe 125.

Figure 12:
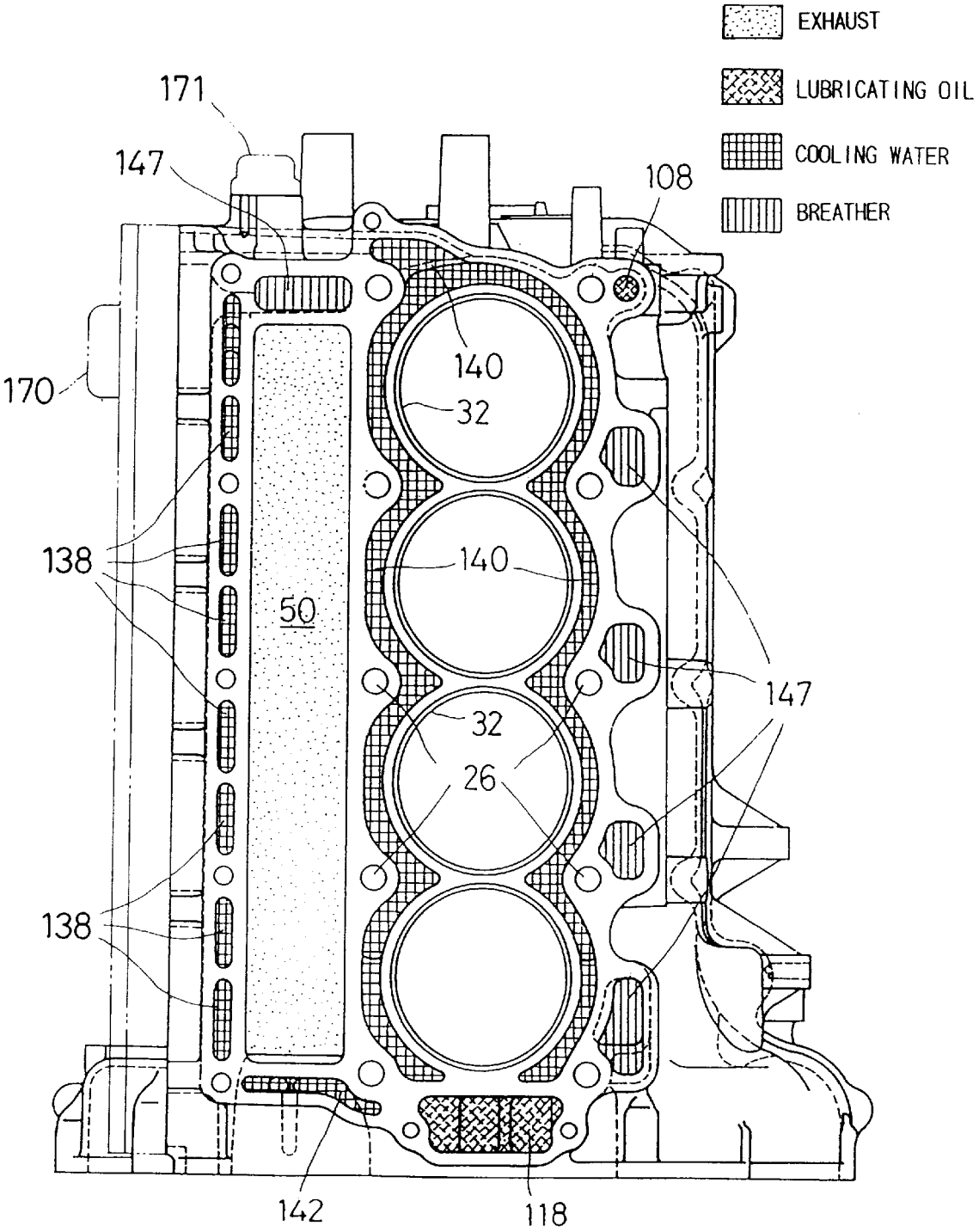
FIG. 12 is a view showing a joining face of the cylinder block.

As shown in FIG. 11, cooling water rising passages 126, 127, 128, 129 and a cooling water descending passage 130 are formed in the mount case 5 and the cylinder block 21 positioned around the exhaust passage 52 passing through the mount case 5 vertically and the exhaust hole 51 communicating with the exhaust passage 52 and passing through the cylinder block 21 vertically. The passage 129 is a branch passage for pressure relief connected to a pressure relief valve 170 (FIG. 12) at an upper portion of the cylinder block. The passage 129 is communicated with the descending passage 130 through the pressure relief valve 170. The passages 126, 127, 128 are communicated with cooling water passages in the engine main body as mentioned below, and at an uppermost position of the cooling water passage is provided a thermostat 171 (FIGS. 2 and 12).

In the cylinder block 21, a cooling water passage 137 (FIG. 8) communicating with the cooling water rising passage 126 of the mount case 5 (FIG. 11) is formed. As shown in FIGS. 8 and 12 the cooling water passage 137 communicates with a cooling water passage 138 on the outside of the exhaust passage 50 and the passage 138 communicates with a cooling water passage 139 of the cylinder head 22.

The cylinder block 21 is formed with a water jacket 140 communicating with the cooling water rising passage 127 of the mount case 5. An opening end of the water jacket 140 communicates with a cooling water passage 141 of the cylinder head 22 as shown in FIGS. 7 and 8.

Figure 13:
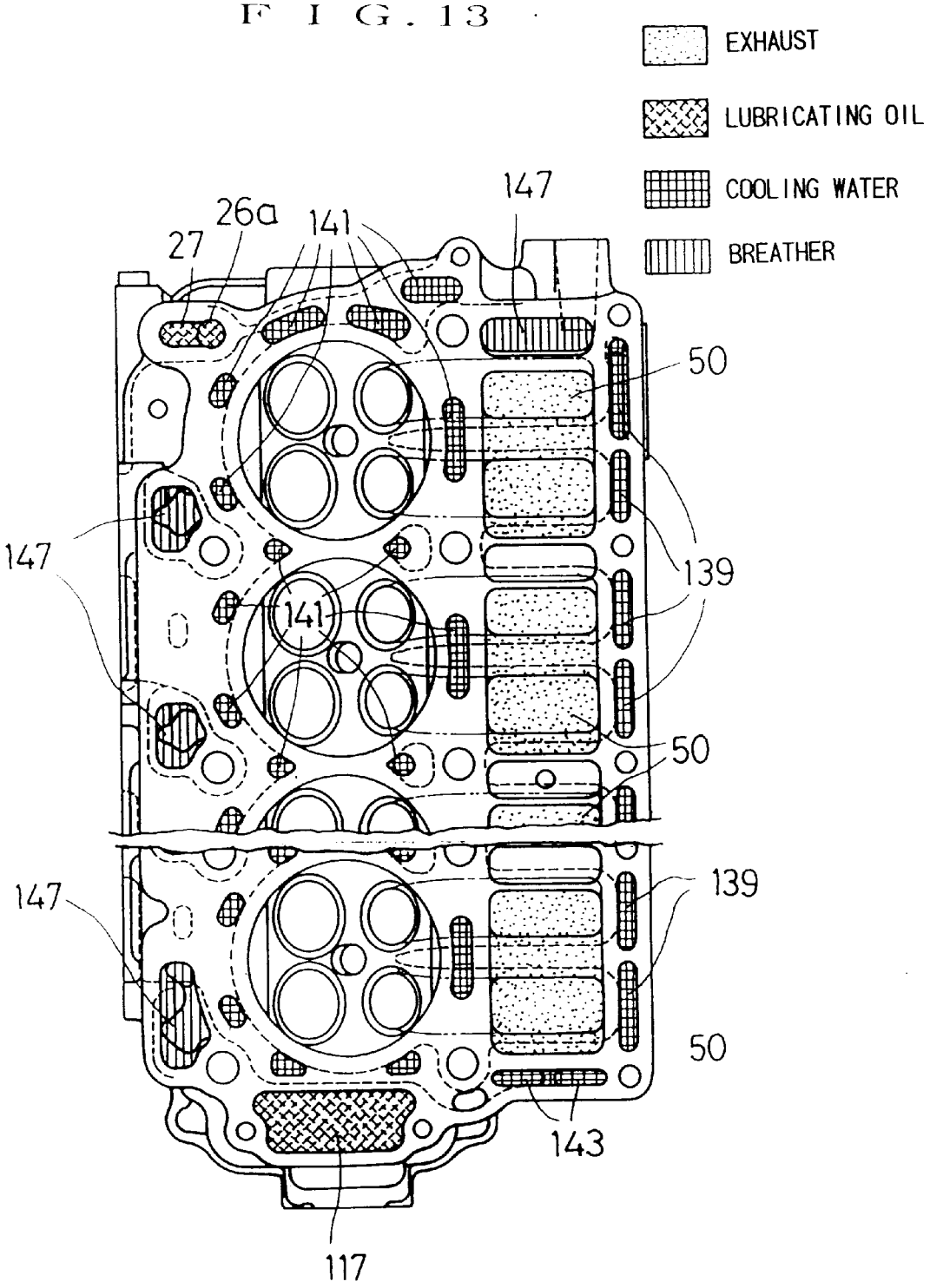
FIG. 13 is a view showing a joining face of the cylinder head.

Further, the cylinder block 21 is formed with a cooling water passage 142 at a position near the joint portion of the cylinder block 21 and the cylinder head 22 with respect to the exhaust passage 50 and the aforementioned cooling water rising passage 128 of the mount case 5 communicates with the cooling water passage 142. A cooling water passage 143 communicating with the cooling water passage 142 is formed in the cylinder head 22 (FIG. 13).

As shown in FIG. 8, in the cylinder block 21, a cooling water passage 144 is formed on the outside of the cooling water passage 137 communicating with the cooling water rising passage 129, and in the neighborhood of the cooling water passages 137, 138, 144 is formed a cooling water passage 145 which communicates with the cooling water descending passage 130. The cooling water sent out from the cooling water pump 123 is supplied to the cooling water passages 139, 141, 143 of the cylinder head 22 through the cooling water passages 126, 127, 128, 129 of the mount case 5, and the cooling water passages 137, 138, 142, 144 of the cylinder block 21, then discharged outside through the cooling water passage 145 of the cylinder block 21 and the cooling water descending passage 130 of the mount case 5.

As shown in FIG. 8, a breather passage 147 communicating with the crank chamber 132 and the valve moving chamber 35 is connected with a breather chamber 149 through a hole 148.

When the vertical internal combustion engine 1 is started and becomes in an operation state, the crankshaft 30 and the rotor 38 of the lubricating oil pump 81 integrally fitted to the crankshaft rotate and lubricating oil in the oil pan 6 is sucked into the pump chamber 84 through the strainer 89, the suction pipe 88 and the suction port 86. Then the lubricating oil is sent to the intake portion 96 of the oil filter 95 through the vertical oil passage 90, the longitudinal horizontal oil passages 91, 92 and the horizontal oil passage 94 to be filtered by the oil filter 95. After that, the lubricating oil is supplied to the crankshaft oil passage 99, the balancer shaft oil passage 100 and the balancer shaft oil passage 101 through the communication oil passage 98.

The lubricating oil supplied to the crankshaft oil passage 99 is sent to the journal bearings 31 of the crankshaft 30 to lubricate them, through the crankshaft oil passages 102 provided in the crankshaft supporting portions 103 directing rearward as shown in FIGS. 7 and 10.

Referring to FIG. 4, the lubricating oil which has lubricated any journal bearing 31 flows down into a crank chamber 132 directly below the journal bearing, then passes through a communication hole 131 of a crankshaft supporting portion 103 at the bottom of the crank chamber to flow down into the next crank chamber 132. Thus the lubricating oil reaches the lowermost crankshaft supporting portion 103*b* and flows into the flat oil passage space 111 (FIG. 5) eventually.

The lubricating oil in the flat oil passage space 111*b* drops onto an upper surface of the mount case 5 through the return oil hole 114, the partitioned space 113*b* and the vertical communication hole 136*b*. Another lubricating oil flowing into the flat oil passage space 111*a* of the lowermost crankshaft supporting portion 103*b* in the same manner as the above, drops onto an upper surface of the mount case 5 through the partitioned space 113*a* and the vertical communication hole 136*a*.

The lubricating oil on the upper surface of the mount case 5 drops in the oil pan 6 through a return oil passage provided in the mount case 5.

Referring to FIG. 7, a part of the lubricating oil supplied to the journal bearing 31*a* of the crankshaft 30 to lubricate it through the crankshaft oil passage 102*a* of the uppermost crankshaft supporting portion 103*a* is further supplied to a portion 38*a* to be lubricated of the camshaft 38 through the cam shaft oil passages 107, 108, 109 for lubricating the portion 38*a*. The lubricating oil is supplied in the camshaft 38 through the rocker oil passage 110 to lubricate friction parts of the valve moving device, collects in the valve moving chamber 35, flows into the oil passage space 119 of the mount case 5 through the return oil passages 117, 118 as well as the communication pipe 120 parallel with the return oil passages, and then returns to the bottom of the oil pan 6 through the return oil pipe 122 (FIG. 4).

Another lubricating oil entering the balancer shaft oil passages 100, 101 from the communication oil passage 98 flows through the balancer shaft oil passages 104, 105 (FIGS. 7, 9, 10) to lubricate the upper portions 65*a*, 66*a* of the balancer shafts 65, 66 (FIG. 6), then the lubricating oil goes down by gravity and lubricates the lower pivot portions 65*b*, 66*b* of the balancer shafts 65, 66. Thus if only the balancer shaft passages 104, 105 are provided to the balancer shafts 65, 66 respectively, middle bearing portions and lower end bearing portions of the balancer shafts 65, 66 are also lubricated so that the balancer lubricating system is simplified greatly and cost can be reduced.

Referring to FIG. 6, a lubricating oil flowing into the balancer shaft oil passage 106 from the balancer shaft oil passage 105 is supplied to the pivot portion 62*a* of the balancer driven pulley 92 through the camshaft oil passage 107 to lubricate the pivot portion 62*a* with the very simple lubricating construction.

The lubricating oil which has lubricated the balancer shafts 65, 66 drops down and flows into the oil passage space 111*b* through the work hole 134*a* of the lowermost crankshaft supporting portion 103*b*. The lubricating oil in the oil passage space 111*b* returns into the oil pan 6 through the return oil hole 114, the partitioned space 113*b* (FIG. 11) and the vertical communication hole 136*b* in turn.

Since the pivot hole 133*a* pivotally supporting the upper end of the balancer shaft 65 (66) at the uppermost crankshaft supporting portion 103*a*, the pivot holes 133 in the middle crankshaft supporting portions 103 which the balancer shaft passes through, the work hole 134*a* pivotally supporting the lower end of the balancer shaft at the lowermost crankshaft supporting portion 103*b* and the work hole 134*b* formed under the hole 134*a* are arranged in a straight line as shown in FIG. 6, these holes can be worked easily by a tool. Particularly the upper pivot holes 133 can be finished by a tool having a lower end supported by the work holes 134*a*, 134*b* with a high productivity. Since the plug 135 is fitted in the lower work hole 134*b*, lubricating oil in the oil passage space 111 never flows into the flywheel space A under the space 111.

As shown in FIGS. 7, 12 and 13, the camshaft oil passages 107, 108, the communication passage 27, the hole 26*a* for inserting the bolt 26 and the cam shaft oil passage 109 leading to the pivot portion 38*a* of the cam shaft 38 from the uppermost journal bearing 31*a* of the crankshaft 30 are arranged on the opposite side to the exhaust passage 50, so that lubricating oil passing through these oil passages is hardly heated and prevented from deterioration.

The vertical internal combustion engine 1 according to a preferred embodiment of the present invention is provided with cooling means for cooling the lubricating oil at oil passages leading to the oil filter 95 from the lubricating oil pump 81, particularly at the vertical oil passage 90 and the longitudinal horizontal oil passage 91, so that the lubricating oil can be cooled sufficiently as it flows from the lubricating oil pump 81 to the oil filter 95.

Namely, as shown in FIGS. 1, 5, a part of an outer surface of a right side wall of the cylinder block 21 corresponding to the vertical oil passage 90 and the longitudinal horizontal oil passage 91, which are arranged along an inner side of the side wall as mentioned above, is covered by a cover member 150 to form a cooling water chamber 151 for circulating the cooling water.

Figure 14:
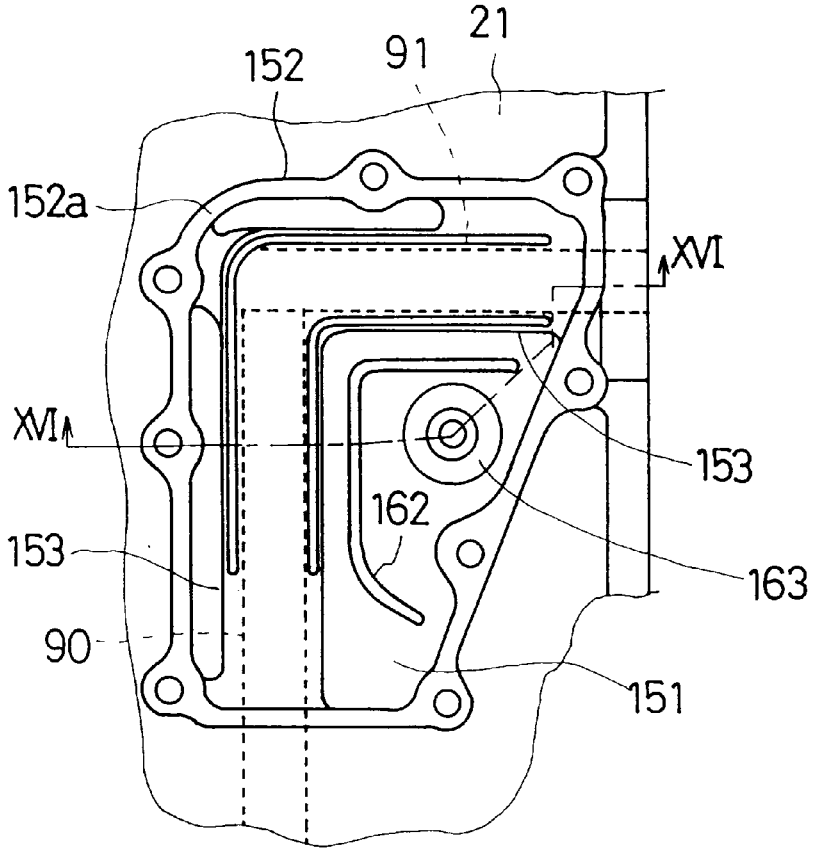
FIG. 14 is a front view of a cooling water chamber from which a cover member is removed.
Figure 15:
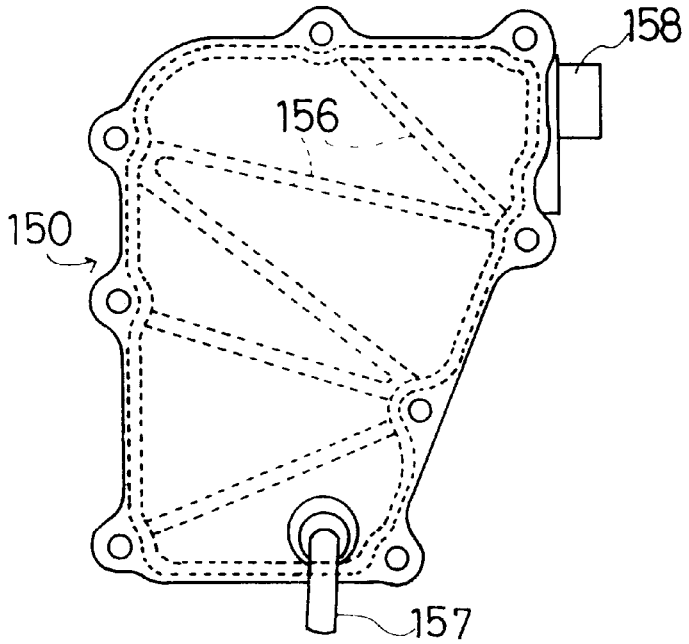
FIG. 15 is an outside view of the cover member.
Figure 16:
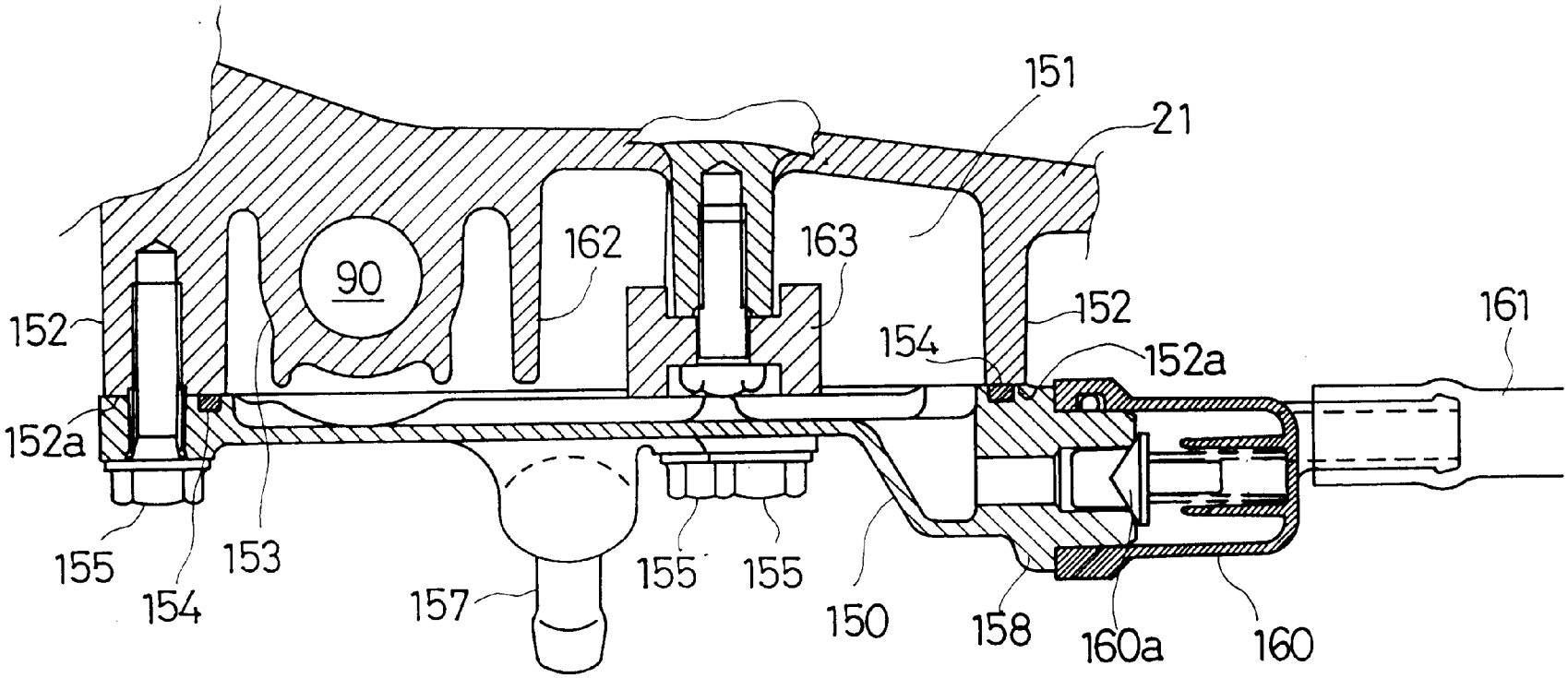
FIG. 16 is a section of the cooling water chamber covered by the cover member taken substantially along the line XVI—XVI of FIG. 15.

FIG. 14 is a front view showing the cooling water chamber 151 on the outer surface of the right side wall of the cylinder block 21 removing the cover member 150, FIG. 15 is an outside view of the cover member 150 and FIG. 16 is a section of the cooling water chamber 151 covered by the cover member 150 substantially taken along the line XVI—XVI of FIG. 15. As shown in these figures, on the outer surface of the cylinder block 21 is projected an enclosure wall 152 surrounding the cooling water chamber 151. The oil passages 90, 91 are arranged on the reverse side of the cylinder block side wall portion surrounded by the enclosure wall 152, and the side wall is swelled outward at a portion corresponding to the oil passages 90, 91 to form a swelled portion 153 along the oil passages 90, 91.

Therefore, the oil passages 90, 91 at the swelled portion 153 are precisely positioned within the cooling water chamber 151 so that a good heat exchange is carried out between the cooling water in the cooling water chamber 151 and the lubricating oil in the oil passages 90, 91 through the swelled portion 153.

The cover member 150 is fitted on an upper face 152*a* of the enclosure wall 152 through a seal member 154 and fixed by bolts 155. As shown in FIG. 15, the cover member 150 is reinforced by ribs 156 formed on the inner surface, and has a water supply mouth piece 157 provided at a lower part penetrating it and a water discharge mouth piece 158 provided at an upper side portion. The water supply mouth piece 157 is connected with a cooling water supply pipe 159 as shown in FIG. 1, and the water discharge mouth piece 158 is connected with a cooling water discharge pipe 161 through a pressure regulating valve 160 as shown in FIGS. 1, 16.

The cooling water brought into the cooling water chamber 151 through the water supply mouth piece 157 from the cooling water supply pipe 159 opens a valve body 160*a* of the pressure regulating valve 160 to be discharged to the cooling water discharge pipe 161 when the pressure of the cooling water reaches a predetermined value. Thus, the lubricating oil in the oil passages 90, 91 leading to the oil filter 95 from the lubricating oil pump 81 is cooled by the cooling water flowing in the cooling water chamber 151. In order to let the cooling water flow along the oil passages 90, 91, a guide rib 162 is provided in the cooling water chamber 151. Further, an anode metal 163 is provided for preventing the cylinder block wall and the cover member 150, which are made of aluminum alloy, from being corroded by the cooling water flowing in the cooling water chamber 151.

The cooling water supply pipe 159 and the cooling water discharge pipe 161 are arranged along the outer side surface of the engine main body. Branch pipes 159*a*, 161*a* may be provided on the pipes 159, 161, respectively, as shown in FIG. 1. In this case, diameters of the branch pipes 159*a*, 161*a* are made small to restrain the flow rate thereof. The cooling water supply pipe 159 extends surrounding a portion below the head cover 23 to the reverse side (left side with respect to the ship body) to be connected to a cooling water take-out mouth piece 164 (FIG. 17) provided on a left (right in the figure) rear portion of the mount case 5. The mouth piece 164 branches from a cooling water passage 165 formed at an upper stream side (lower side) of the cooling water rising passage 129.

Figure 17:
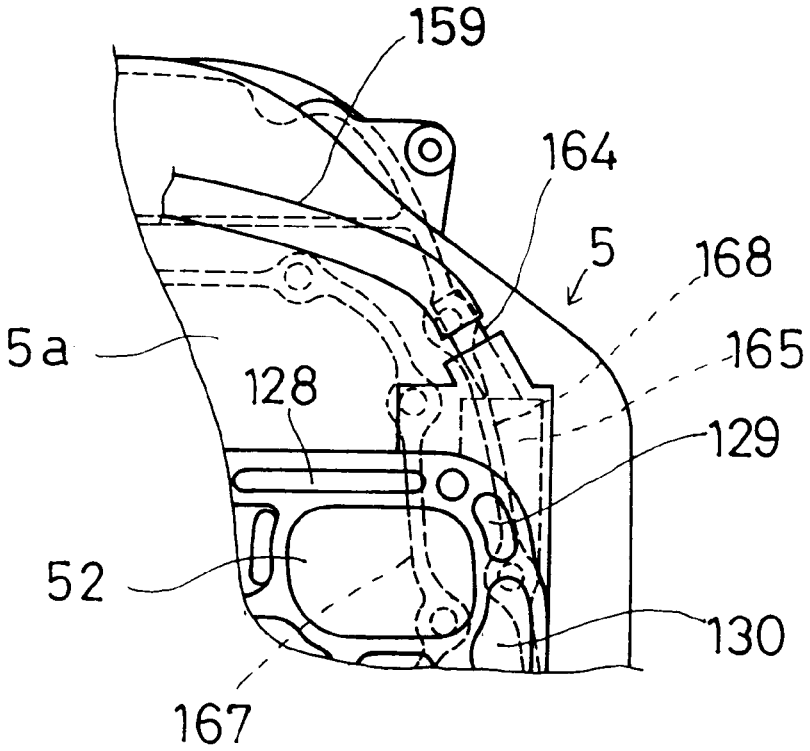
FIG. 17 is a plan view showing a left rear part of a mount case.
Figure 18:
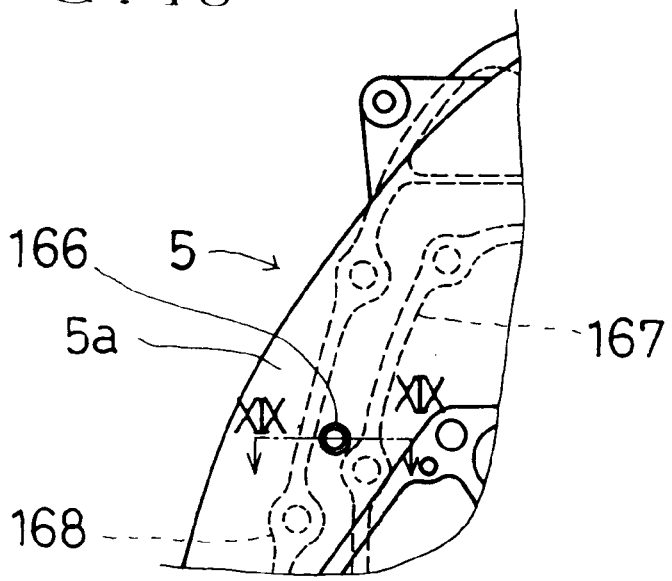
FIG. 18 is a plan view showing a right rear part of the mount case.
Figure 19:
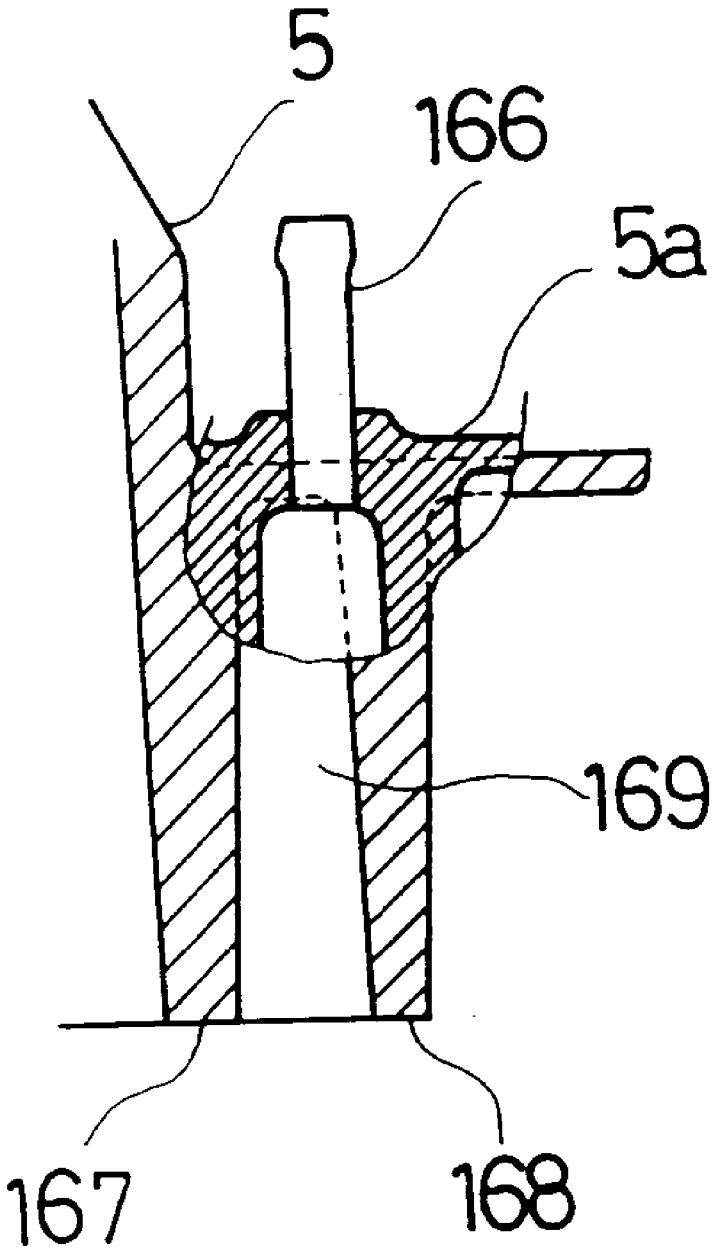
FIG. 19 is a section taken along the line XIX—XIX of FIG. 18.

On the one hand, the cooling water discharge pipe 161 is bent downward at the right side face of the cylinder block 21 and connected to a joint mouth piece 166 projected on a upper surface 5*a* of a part of the mount case 5 swelled laterally (FIGS. 1, 18, 19). In FIGS. 17, 18, a packing face 167 for attachment of the oil pan and a packing face 168 for attachment of the extension case formed on the lower surface of the mount case 5 are shown by dotted lines. The joint mouth piece 166 is positioned between the packing faces 167 and 168 and communicated with a groove 169 formed between the packing faces 167 and 168 (FIG. 19). The lower opening of the groove 169 is closed by a packing member, but the packing member has a hole and the cooling water dropped into the groove 169 through the cooling water discharge pipe 161 and the joint mouth piece 166 is dropped into the extension case 3 at the bottom through the hole.

The lubricating oil cooling water flowing in the cooling water chamber 151 is taken out by the cooling water take-put mouth piece 164 from the cooling system leading into the engine main body through the cooling water rising passages 126, 127, 128, 129 from the cooling water pump 123, and discharged merely into the extension case through the joint mouth piece 166 after passing through the cooling water chamber 151. Therefore, the cooling water pump 123 is required discharge ability larger by the amount of the lubricating oil cooling water to cause large-sizing of the pump.

Accordingly, as mentioned above, the cooling water chamber 151 is connected with the cooling water discharge pipe 161 through the pressure regulating valve 160 which does not open to let the cooling water flow in the cooling water chamber 151 until a sufficient cooling water pressure is ensured in the cooling system within the engine main body and pressure in the cooling water chamber 151 reaches a predetermined value. Therefore, when the engine is operated at a low speed, namely, when discharge pressure and discharge volume of the cooling water pump are low, the regulating valve 160 closes to restrain the cooling water passing the cooling water chamber 151 and discharged from the cooling water discharge pipe 161, so that the cooling water to be supplied to the cooling water chamber 151 can otherwise be supplied into the engine main body and the cooling water pump need not be made larger.

What is claimed is:

1. A vertical internal combustion engine including a crankshaft directed substantially in a vertical direction, a lubricating oil pump, an oil filter and a cooling water pump, comprising:

a lubricating oil passage arranged along a side wall of a main body of said internal combustion engine extending between said lubricating oil pump and said oil filter;

a cooling water chamber formed around said lubricating oil passage; and a branch water passage branching at a discharge side of said cooling water pump from a cooling water passage leading into the main body of said internal combustion engine and communicating with said cooling water chamber, wherein said oil filter is mounted to said main body of said internal combustion engine separately from said cooling water chamber.

2. A vertical internal combustion engine as claimed in claim 1, wherein said cooling water chamber is connected with a cooling water discharge passage through a pressure regulating valve.

3. A vertical internal combustion engine as claimed in claim 1, wherein said lubricating oil passage is arranged inside of a side wall of the main body of said internal combustion engine, and a part outside of said side wall corresponding to said lubricating oil passage is covered by a cover member to form said cooling water chamber.

4. A vertical internal combustion engine as claimed in claim 1, wherein said main body of said internal combustion engine is placed on an extension case of an outboard motor through a mount case, and said branch water passage is connected with said cooling water passage leading into said main body at interior of said mount case.

5. A vertical internal combustion engine as claimed in claim 2, wherein said main body of said internal combustion engine is placed on an extension case of an outboard motor through a mount case, and said cooling water discharge passage is communicated with interior of said extension case through said mount case.

6. A vertical internal combustion engine including a main body placed on an extension case of an outboard motor through a mount case, a crankshaft directed substantially in a vertical direction, a lubricating oil pump, an oil filter and a cooling water pump, comprising:

a lubricating oil passage arranged along a side wall of a main body of said internal combustion engine extending between said lubricating oil pump and said oil filter;

a cooling water chamber formed around said lubricating oil passage;

a branch water passage branching at a discharge side of said cooling water pump from a cooling water passage leading into the main body of said internal combustion engine and communicating with said cooling water chamber, said branch water passage being connected with said cooling water passage leading into said main body at interior of said mount case; and a cooling water discharge passage connected with said cooling water chamber through a pressure regulating valve, said cooling water discharge passage communicating with an interior of said extension case of said outboard motor through said mount case.

* * * * *